US005871430A

United States Patent [19]

Mueller

[11] Patent Number: 5,871,430

[45] Date of Patent: Feb. 16, 1999

[54] CONTAINER-MAKING MACHINE

[75] Inventor: Berthold Mueller, Suessen, Germany

[73] Assignee: Michael Hoerauf Maschinenfabrik GmbH & Co. KG, Germany

[21] Appl. No.: 446,575

[22] Filed: May 19, 1995

[30] Foreign Application Priority Data

May 21, 1994 [DE] Germany ..... 44 17 939.1

[51] Int. Cl.[6] ..... B65B 59/00; B31C 7/02

[52] U.S. Cl. ..... 493/105; 493/109; 493/475

[58] Field of Search ..... 493/66, 105, 106, 493/107, 108, 109, 154, 155, 163, 164, 167, 169, 170, 173, 175, 180, 474, 475, 476, 477, 478, 479, 480

[56] References Cited

U.S. PATENT DOCUMENTS

| | | | |
|---|---|---|---|
| 1,755,513 | 4/1930 | Newton . | |
| 2,369,205 | 2/1945 | Balton . | |
| 3,566,762 | 3/1971 | Vadas . | |
| 3,958,501 | 5/1976 | Richards . | |
| 4,085,664 | 4/1978 | Farfaglia | 493/105 |
| 4,100,842 | 7/1978 | Richards | 493/109 |
| 4,232,590 | 11/1980 | Johnson | 493/105 |
| 4,452,596 | 6/1984 | Clauss | 493/107 |
| 4,490,130 | 12/1984 | Konzal | 493/106 |
| 5,324,249 | 6/1994 | Konzal | 493/109 |
| 5,435,804 | 7/1995 | Konzal | 493/125 |
| 5,624,367 | 4/1997 | Budziszewski | 493/167 |

OTHER PUBLICATIONS

BMP 12 Maschine zur vollautomatischen Herstellung von Papierbechern, Maschinenfabrik Michael Hörauf, 4 pages—no translation.

*Primary Examiner*—Joseph J. Hail, III
*Assistant Examiner*—Christopher W. Day
*Attorney, Agent, or Firm*—Evenson, McKeown, Edwards & Lenahan, P.L.L.C.

[57] ABSTRACT

A machine for producing containers comprises processing stations with components adaptable to the shape and size of the material sections used for the container. In the case of a change in form, in particular a change in the format of the sections of material to be used, it is necessary to change the relevant adaptable components. Instead of the conventional approach where the new components must be fine-tuned after an exchange has taken place, fitting surfaces are provided at the processing stations, against which a section of the adaptable components can always be placed in the same position. Therefore, time-consuming installation of exchangeable machine components is avoided.

10 Claims, 6 Drawing Sheets

18
19
20
21
23
24
25
26
27
28
39
40
42
43
44
45
46
47
69
73
74

CONTAINER-MAKING MACHINE

BACKGROUND AND SUMMARY OF THE INVENTION

The present invention relates to a machine for producing containers from sections of material, and more particularly to a machine comprising processing stations for taking up, feeding and/or forming these material sections in various production stages, whereby at least one processing station comprises an adaptable component which matches the shape of the material sections and is detachable from the processing station when a change of adaptable component is required.

A machine with a plurality of processing stations for producing containers is known from the Michael Hörauf Maschinenfabrik brochure with the title "BMP 12: A machine for the completely automated production of paper cups". The majority of the processing stations contain adaptable components, in particular adaptable tools, which are adapted to the format of the material used. In the case of a format change in the material sections presented, it is necessary to change the adaptable components, for example the mandrels, for other components which are adapted to this changed format. These components have to be adjusted in relation to their position before or during assembly in the machine. If, in the case of a change back to the original format, the exchanged components are to be used again, these must be adjusted anew.

It is an object of the present invention to reduce the time-consuming work involved during the exchange of adaptable components.

This object has been achieved by providing that the processing stations contain at least one fitting device, on which at least one fitting surface is fixed and against which fitting surface the countersurface of an adaptable component can be placed so that it rests exactly the same. The component section thus always takes up the same position in the processing station.

An adaptable component is always placed in exactly the same position in the processing station, independently of how the area of the adaptable component which has been adapted to a changed format looks. After assembly in the machine, the adaptable component takes up an exact predetermined position in relation to the material sections to be used and to the remaining components of the processing station.

All the sections of an adaptable component do not always have to have the same position in the processing station. It is important, however, that the section of the adaptable component, which can be placed against the fitting device and be formed as a holding part, always takes up the same position. The position of the section of the adaptable component which comes into contact with the material sections and which is adapted to their form, is determined by the position of the section placed against the fitting device.

The adaptable component is advantageously arranged stationary on the machine or on a movable element of the machine. However, it is also possible that only the section which lies against the fitting device is stationary, while the section which comes into contact with the material sections is movable. Due to the constantly fixed position of the lay-on section, a basic position of the movable section is fixed, whereby the remaining positions of the movable section, which are taken up by same during the motion sequence, are predetermined before being built into the machine. The basic position can be a starting position, an intermediary position or an end position, depending on the motion sequence. The adaptable component can be formed and arranged so that at least one position of the movable section, for example the starting position or the end position, is constantly the same.

"Adaptable components" include such components which come into contact with the material sections in any way, be it for a brief take-up interval, for temporary supporting, transporting, processing or treating, and whose structure or arrangement in the machine is dependent on the structure, in particular the format, of the material sections. Adaptable tools, which, for example, are used to form material sections, or for other work processes, as well as other adaptable components, are hereby included.

The material sections can have different structures. They can, by way of example, be in the form of flat blanks and in a later production step have a cylindrical or conical form.

The position of the fitting device at a processing station is fixed and does not change when an adaptable component is exchanged. It is, of course, possible that the position of a fitting device is reset once.

Advantageously with respect to the adaptable component, the section which is adapted to the structure of the material section, in particular to its format, is connected to the section which can be laid on the fitting device in a non-movable way. This is particularly advantageous when the adaptable component does not have any movements to make, which, independent of the structure of the material section to be processed, may be different.

A further advantage is that the section of the adaptable component, which is adapted to the material section form, is arranged such that it is adjustable relative to the section which can be placed on the fitting device. The exact adjustment outside of the machine can now be predetermined.

All devices, which have at least one fitting surface against which a countersurface can be placed matching exactly to it, can be considered as fitting-devices. It is possible, and usually purposeful, to provide a plurality of fitting devices for one adaptable component at one processing station. Similarly, one fitting device with a plurality of fitting surfaces can be provided.

It is also advantageous to construct the fitting device with an arranged fitting surface, and the countersurface on the adaptable component in such a way that the fitting surface and the countersurface are formed from opposing plane surfaces.

In a still further advantageous development of the present invention, the fitting surface and the countersurface are formed from opposing outer and inner circumferences of a cylinder and a hollow cylinder. It is also advantageous to construct the fitting device and the countersurface as aligned fixing bore holes with a positioning pin which can be inserted into them.

Yet another advantageous aspect of the present invention comprises a processing station formed from a device for presenting the material sections and containing an adaptable component which is constructed as a stacking magazine for taking up a stack of material blanks. In this processing station, the simplified exchange of adaptable components is realized particularly effectively.

When the mentioned stacking magazine contains a plurality of supporting surfaces which match the outer contour of the stack, which supporting surfaces are non-movably connected to a holding plate laying on a plane support of the machine frame, advantageously the holding plate and the support comprise aligned fixing bore holes, into which a positioning pin can be inserted.

A further advantageous feature involves a further adaptable component for the presentation of material sections for the above-mentioned device. The further component is constructed as a transporting plate for transporting the blanks to a transporting device. It is thus practical, when the transporting plate contains a suction plate which matches the contour of the material sections to be transported, as well as a holding section, which is connected to a slide in a non-movable way to connect the slide, in turn, to reversing driving rods. Thereby the slide and the holding section comprise aligned fixing bore holes, into each of which a positioning pin can be inserted. In contrast to the above mentioned stacking magazine, the adaptable component is here attached to a movable element of the processing station. Also, the holding section of the adaptable component, which lies on the fitting device of the slide, always takes up the same position.

The suction plate, which comes into contact with the material sections and to whose form it is adapted, can take up different positions, depending on the format, in particular a different starting position and end position. It is, however, also possible with the present invention that the position of the suction plate is not altered after an exchange and that the structure of the suction plate, for example its size and the arrangement of the suction elements, are changed in a simple manner. It is also possible that the end position, at which a material section is taken over by a transporting device, remains the same, while the starting position is altered after an exchange.

Also advantageously, another processing station is formed from a device for slipping a sleeve-shaped container section over a sheet material section to serve as a bottom for the container. Thereby, an adaptable component is formed as a counter-holder for placing a front rim of the sleeve-shaped container section when it is being slipped thereover.

It is particularly advantageous to configure the counter-holder with a supporting ring adapted to the shape of the front rim of the sleeve-shaped container section. The supporting ring is connected adjustably to a threaded bush which, in turn, is connected to a flange arranged fixedly to a turntable. The threaded bush is detachable from the flange so that the inner circumferential surface of the threaded bush lies against an outer circumferential surface of the flange, and a front surface of the threaded bush lies against the front surface of the flange. The threaded bush thus forms the section which lies on the fitting device, and the supporting ring forms the section of the adaptable component which comes into contact with the material sections.

It is a further advantage to provide a further adaptable component at the above mentioned processing station which is formed as a mandrel for lateral support of the sleeve-shaped container section. The mandrel comprises an outer surface which is adapted to the contour of the sleeve-shaped container section and is rigidly attached to a holding part which comprises a hollow cylindrical recess and a front surface. The holding part is separately attached to a rod which, in turn, is attached to the turntable. Consequently, the inner circumferential surface of the hollow cylindrical recess lies against the outer circumferential surface of the flange, and the front surface of the supporting part lies against the front surface of the rod.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
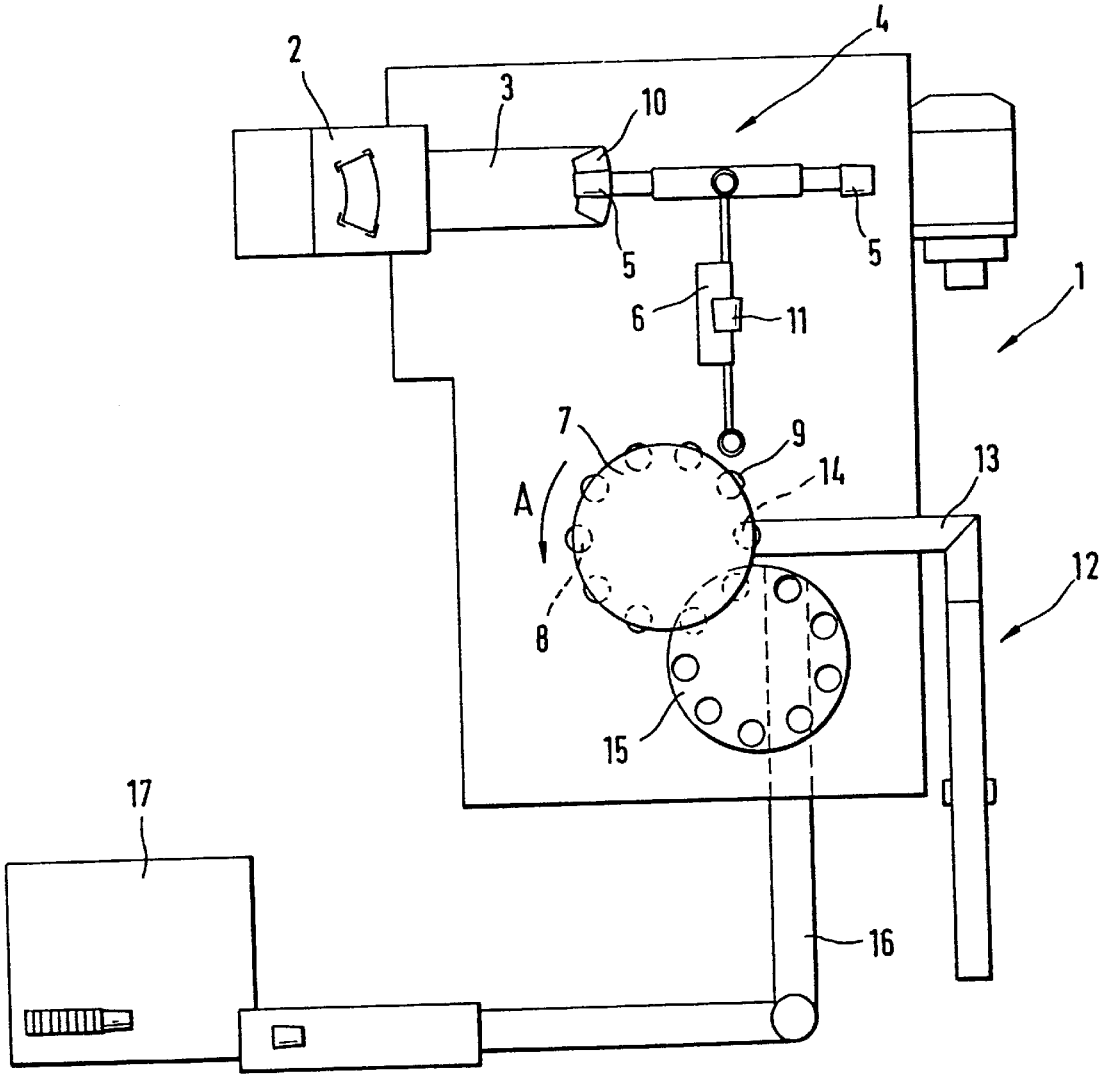
FIG. 1 is a schematic plan view of a machine for producing paper cups in accordance with the present invention.

The machine designated generally by numeral 1 in FIG. 1 produces paper cups which have a conical or cylindrical container body and a bottom. The production of the paper cups takes place in a series of procedural steps described below.

The machine 1 has, as the first processing station, a presenting device 2, at which a stack of material blanks made of coated cardboard is presented for processing. The blanks 10 are taken from the stack and, by way of a transport device 3, individually fed to a second processing station which is formed as a folding device designated generally by numeral 4. At this folding device 4, the blanks 10 are folded around a forming mandrel 5 so that they take on the shape of a conically formed, sleeve-shaped cup section 11.

The sleeve-shaped cup sections 11 are removed from the folding device 4 at a transfer device 6 and fed to a first turntable 7. This first turntable 7 comprises a plurality of processing stations for further processing the sleeve-shaped cup sections 11. Each of these processing stations comprises a mandrel 8. The cup section 11, which has been removed from the folding device 4, is transferred to a processing station which is formed as a sleeve slip-over device 9.

The machine 1 also comprises a bottom feeding device 12, to which a tape 13, made of coated cardboard and used as material for the bottoms of the papers cups, is presented. The tape 13 is fed to a processing station arranged at the first turntable 7 and formed as a bottom punching device 14. Here, round-shaped sheet material sections are punched out of the tape 13 to form the bottoms of the paper cups. The round-shaped, sheet material sections are sucked onto the bottom punching device 14 and remain adhered there while being further processed up to the point where the bottom is attached to the sleeve-shaped cup section 11.

The first turntable 7 is turned in cycles during the production process, whereby the mandrels 8 installed fixedly at the first turntable 7 reach the next processing station after one or more cycles. The rotating direction A of the first turntable 7 is shown in FIG. 1 as anti-clockwise. A plurality of processing stations (not shown in detail) follow the sleeve slip-over device 9 in the rotation direction A. At these stations, the seam of the bottom and the sleeve are heated and where, later in the named area, the two parts are sealed together.

The sleeve-shaped cup section 11 provided with the bottom is now transferred as a half-finished cup to one processing station of a second turntable 15. At every processing station, the second turntable 15 has a recess which matches the shape of the half-finished cup. At the various processing stations (not shown in detail) of the second turntable 15, a lip is applied to the half-finished cup. Finally, the finished cup is removed from the second turntable 15 and fed over a transport device 16 to a magazine 17 in which the finished cups are stacked.

Figure 2:
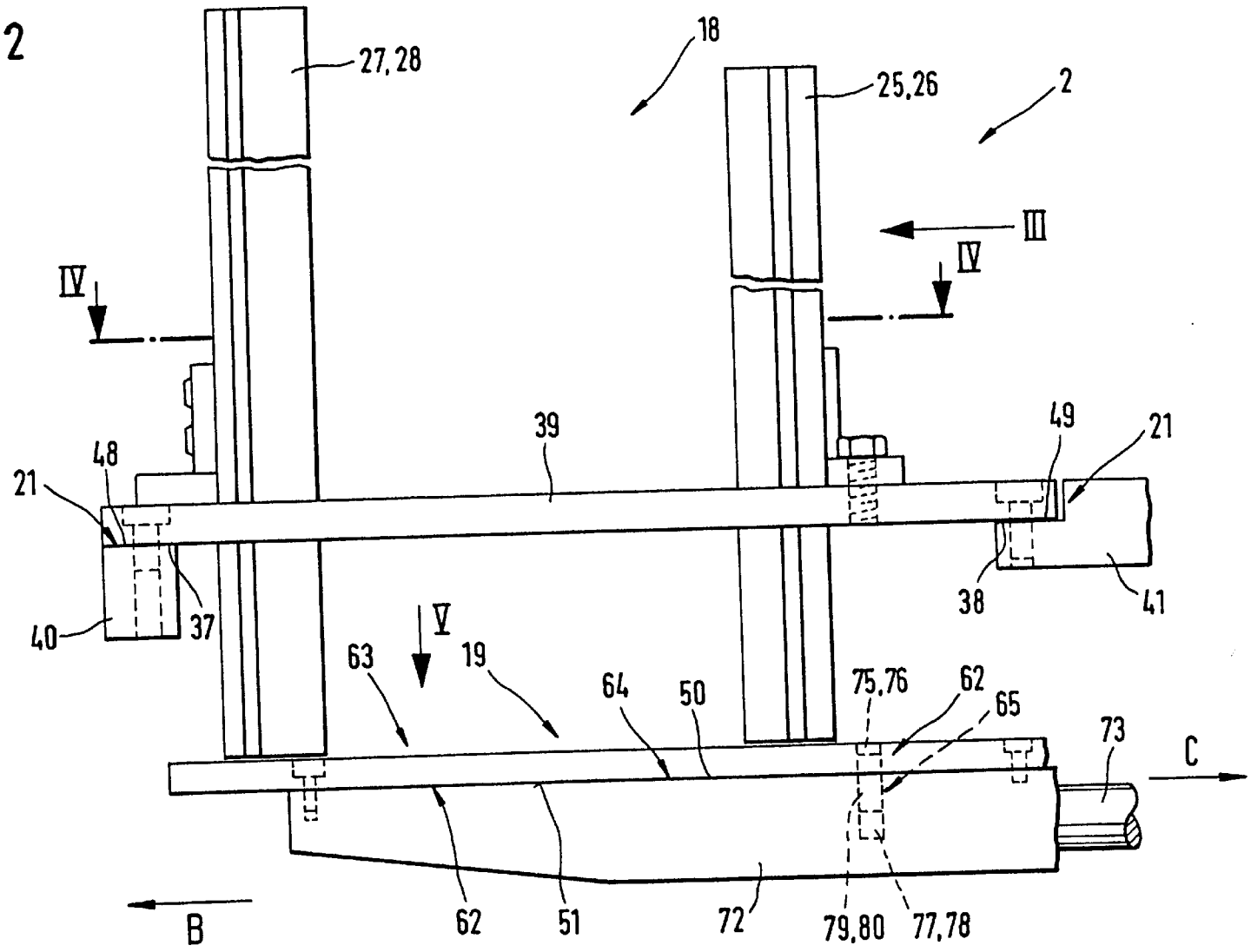
FIG. 2 is an enlarged schematic view of a device for presenting material blanks to the machine for producing paper cups shown in FIG. 1.

A number of devices of the machine 1 for producing paper cups are equipped with components adaptable to the size and shape of the cups. The device 2 for presenting blanks 10 comprises two adaptable components, as can be seen in FIG. 2, namely a stacking magazine designated generally by numeral 18 and a transporting plate designated generally by numeral 19.

Figure 3:
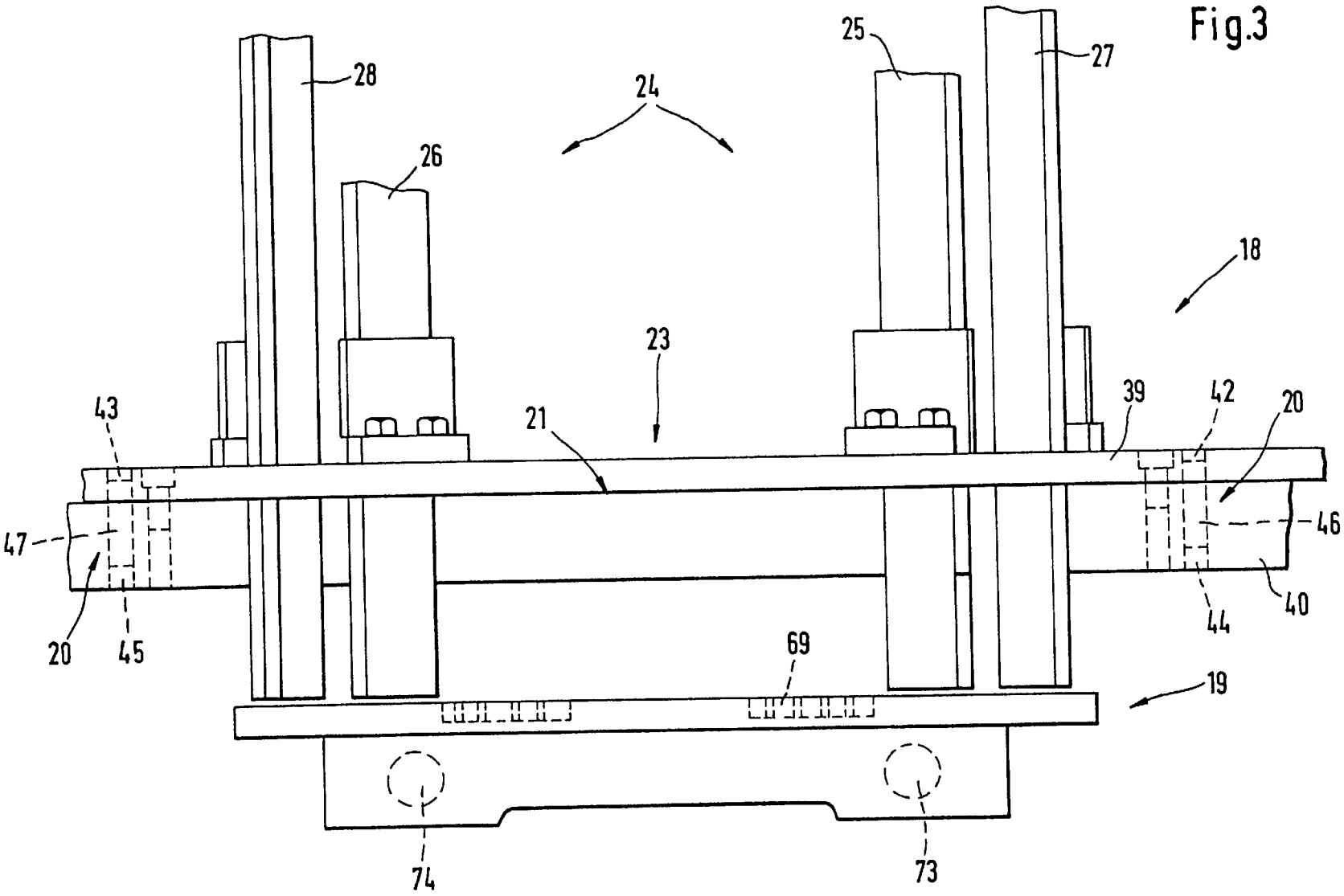
FIG. 3 is a schematic cross-section of the presenting device along the direction of arrow III of FIG. 2.
Figure 4:
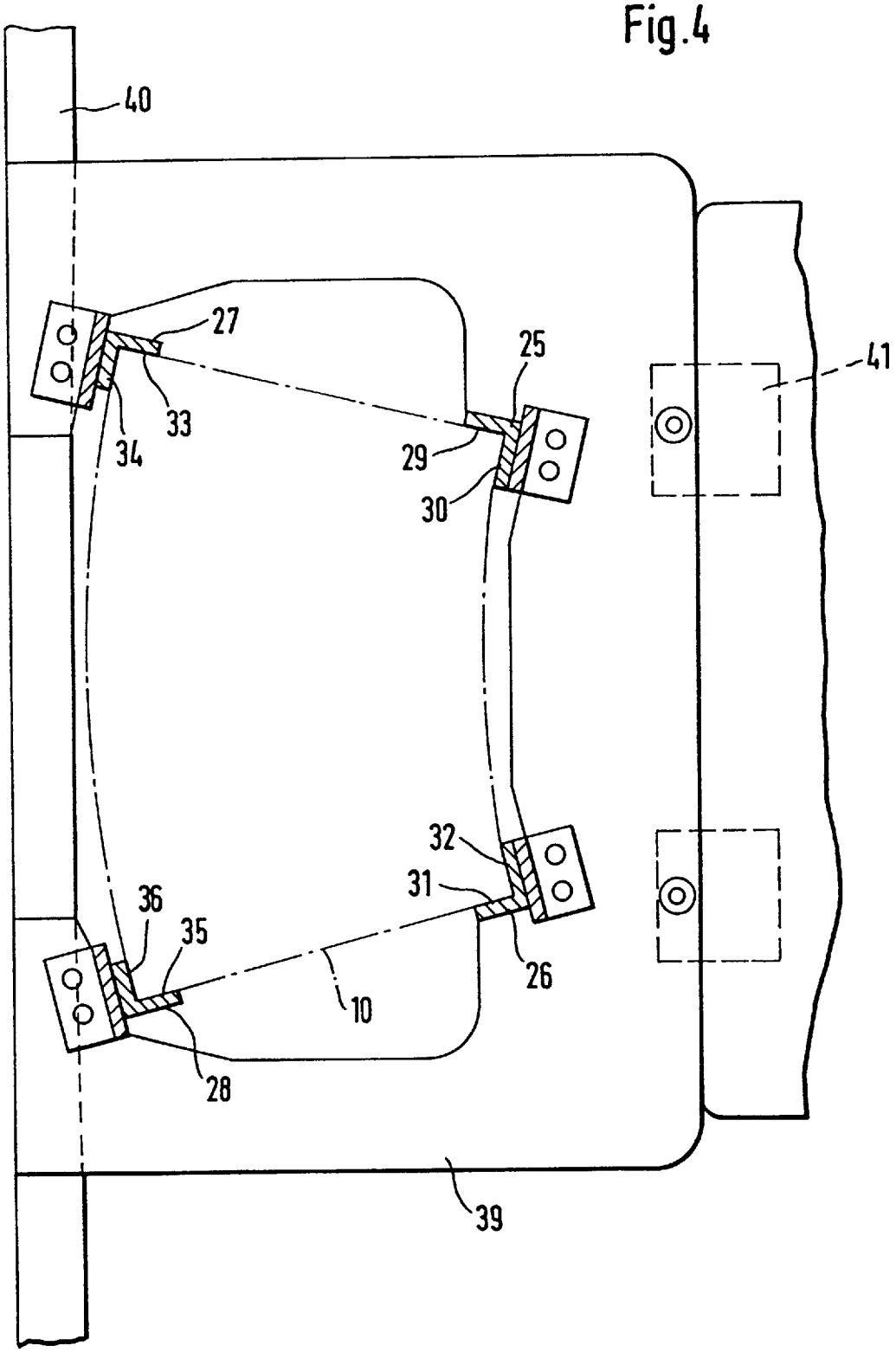
FIG. 4 is a schematic cross-section along line IV—IV of FIG. 2 but on a reduced scale.

The stacking magazine 18 comprises a section 23 which can be placed on fitting devices 20, 21 as seen in FIG. 3 and a section designated generally by numeral 24 which matches the form of the blanks 10. The section 24 which matches the blanks 10 consists mainly of four profiled pillars 25 to 28 provided with supporting surfaces 29 to 36 (FIG. 4). The pillars 25 to 28 are arranged so that their supporting surfaces 29 to 36 border a stack of blanks 10 on the side (in FIGS. 4 and 5 denoted by a dot-dash line) so that they form a hopper for the stack, which hopper is open on the top and bottom.

The section 23 which can be placed on the fitting devices 20, 21 is formed mainly by a holding plate 39 (FIGS. 2 to 4), to which the four profiled pillars 25 to 28 are attached by screws or the like. The holding plate 39 rests on supports 40, 41 provided on the presenting device 2. The supports are formed by tie bars of the machine frame.

The supports 40, 41 have plane surfaces, against which the plane surfaces of the underside of the holding plate 39 rest. In this manner, the supports 40, 41 form the fitting device 21, whose plane surfaces serve as fitting surfaces 48, 49. The plane surfaces of the underside of the holding plate 39 form countersurfaces 37, 38 which rest, matching exactly, on the fitting surfaces 48, 49 and thus fix the vertical position of the holding plate 39.

The holding plate 39 is provided with fixing bore holes 42, 43 (FIG. 3), which correspond to fixing bore holes 44 and 45 on the supports 40, 41. In order to match the holding plate 39 exactly onto the supports 40, 41, the fixing bore hole 42 is aligned with the fixing bore hole 44, and the fixing bore hole 43 is aligned with the fixing bore hole 45. A positioning pin 46 is placed in the aligned fixing bore holes 42, 44; a positioning pin 47 is placed in the aligned fixing bore holes 43, 45 so that the exact position of the holding plate 39 on the supports 40, 41 is also fixed in horizontal direction. The fixing bore holes 42 to 45 form, together with the positioning pins 46, 47, the fitting device 20 with corresponding fitting surfaces and countersurfaces.

If another format of blanks is used, the described holding plate 39 is then not usable any more as a stacking magazine because the profiled pillars 25 to 28 would not rest on the blanks. The stacking magazine 18 must therefore be exchanged for another one which also has profiled pillars but which pillars are spaced differently. In the case of the other stacking magazine, a holding plate is provided in the same way, which is placed on the supports 40,41 on the machine frame. Fixing bore holes are arranged in the holding plate of the other stacking magazine which correspond to the fixing bore holes 42, 43 of the holding plate 39 in relation to their position and their cross section. The holding plate of the second stacking magazine to be used takes up exactly the same position in the presenting device 2 as the holding plate 39 of the exchanged stacking magazine 18.

The other adaptable component of the presenting device 2, namely the transporting plate 19, comprises a section 62 which can be placed on fitting devices 64, 65 and a section 63 (FIGS. 2 and 5) which matches the form of the blank 10. The section 63 which matches the form of the blank 10 comprises a suction plate 68 which has a plurality of suction devices 69 as well as stopping edges 70 arranged according to contour and size of the blank 10 to be used.

The transporting plate 19 is applied at a short distance to the profiled pillars 25 to 28 thereunderneath, so that the stack of blanks 10 rests on the transporting plate 19. The transporting plate 19 lies on a slide 72 and is attached thereto by screws or the like. The upper side of the slide 72 is plane and thus forms a fitting surface 50 of the fitting device 64. The underside of the transporting plate 19 is also planar and forms a countersurface 51 arranged to the fitting surface 50. The slide 72 is attached to rods 73 which are capable of reverse movements in the direction of arrows B and C (FIG. 2).

Figure 5:
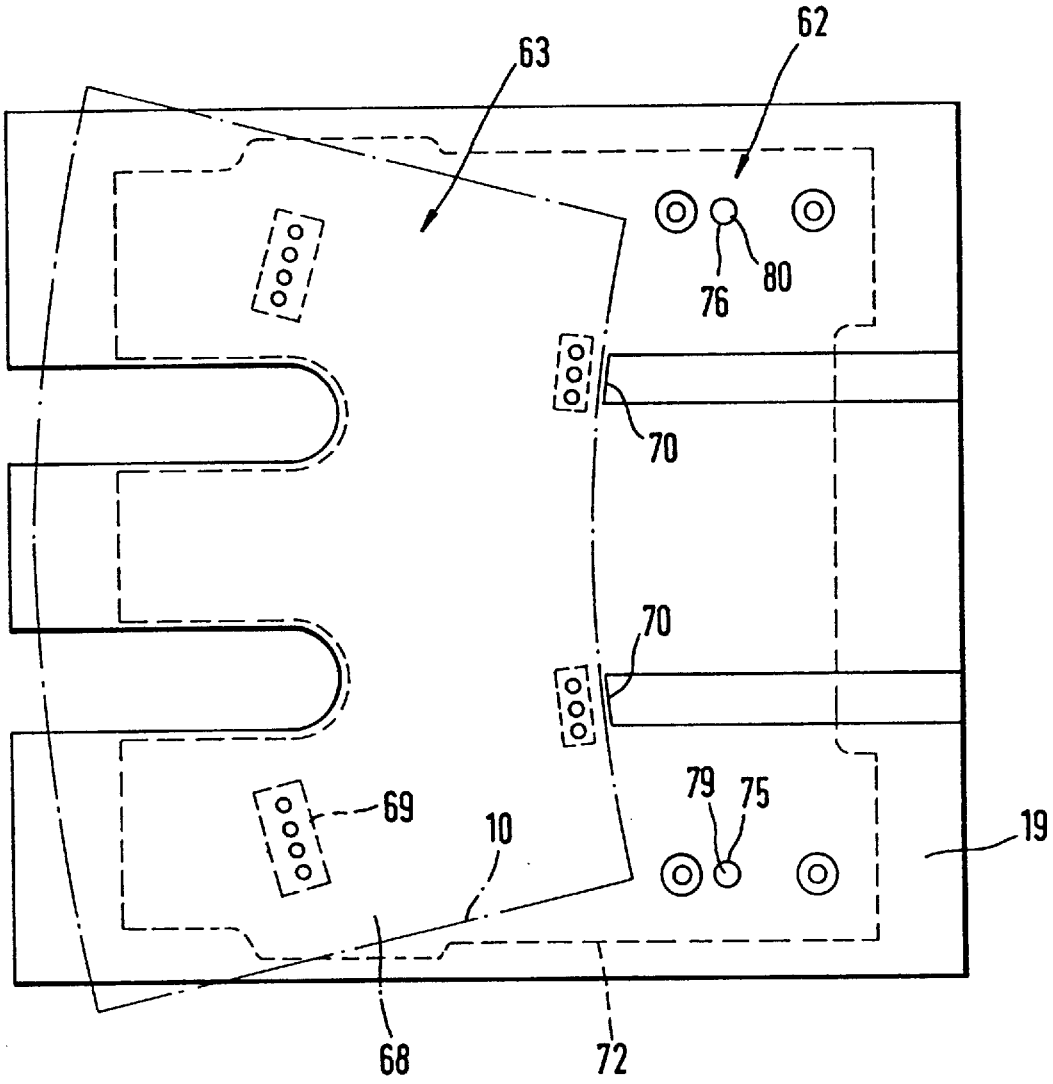
FIG. 5 is a schematic top view on a reduced scale of a transporting plate of the presenting device in the direction of arrow V of FIG. 2.

The transporting plate 19 and the slide 72 are provided with fixing bore holes 75 to 78 (FIGS. 2 and 5). In the case of built-in transporting plates 19, the fixing bore hole 75 is aligned to the fixing bore hole 77, and the fixing bore hole 76 is aligned to the fixing bore hole 78. Thereby, a positioning pin 79 is guided, fitting exactly, into the joined fixing bore holes 75, 77. Likewise, a positioning pin 80, fitting exactly, is guided into the joined fixing bore holes 76, 78. The fixing bore holes 75 to 78 form, together with the positioning pins 79, 80, the fitting device 65 and the fitting and countersurfaces arranged thereto. With the reverse movements made by the slide 72, the suction plate 68 pulls a single blank 10 out of the stacking magazine 18, whereby a small gap is left between the four profiled pillars 25 to 28 and the suction plate 68 so that the blank 10 can be fed through the small gap.

If a blank with another format is now to be processed, the transporting plate 19 must be exchanged for a transporting plate which corresponds to the new format. The new transporting plate has fixing bore holes arranged the same as the fixing bore holes 75, 76 in the transporting plate 19. When the positioning pins 79 and 80 have been placed in, the new transporting plate takes up after assembly, the same position as the exchanged transporting plate 19.

Figure 6:
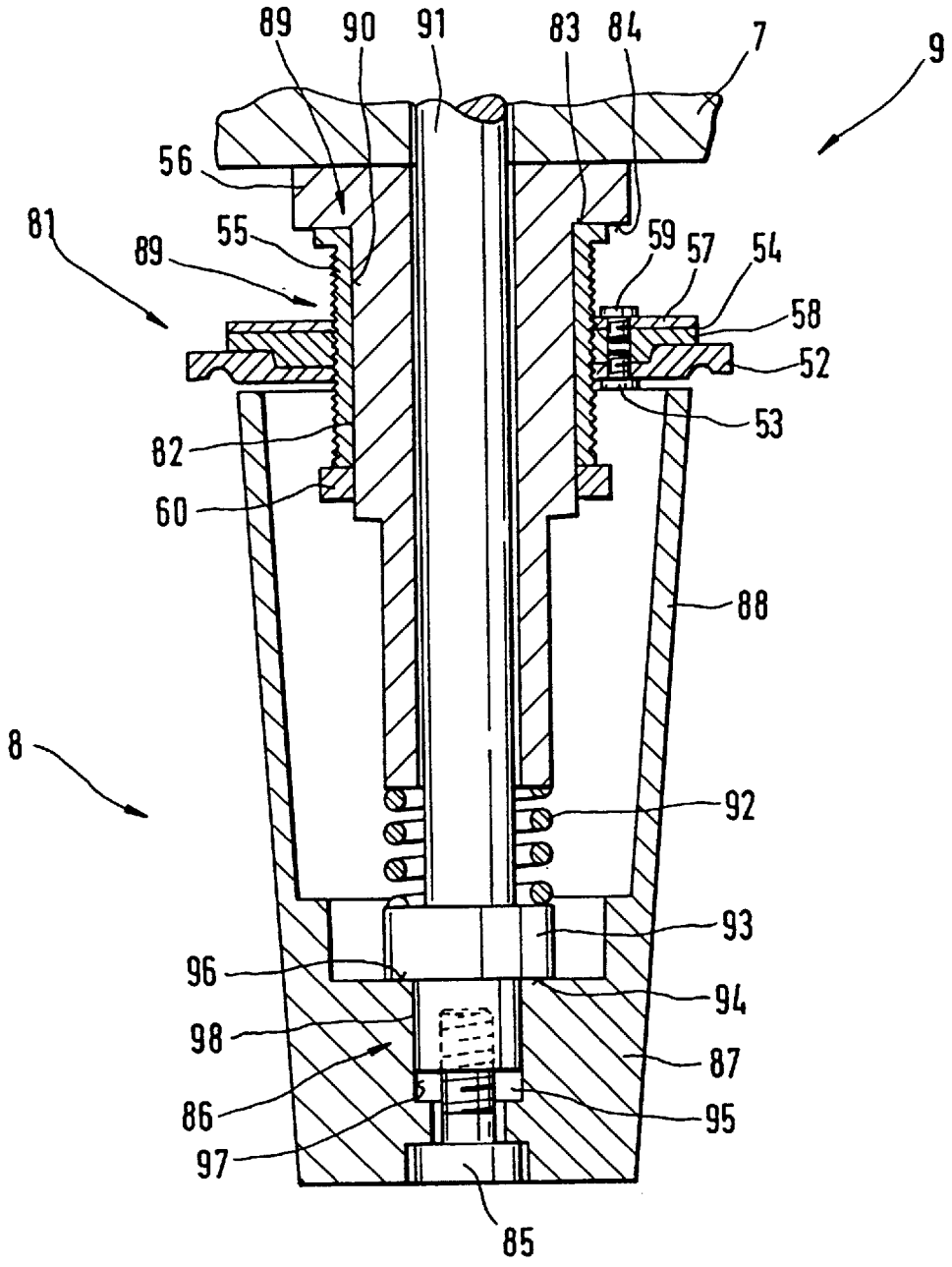
FIG. 6 is a cross-sectional view on an enlarged scale of a device for slipping over cup sleeves in the machine shown FIG. 1.

The sleeve slip-over device designated generally by numeral 9 in FIG. 6 comprises two adaptable components, namely a counter-holder designated generally by numeral 81 as well as the above-mentioned designated generally by numeral mandrel 8. The mechanism by which the bottom is held fast at this production stage at the sleeve slip-over device is not shown, as is the mechanism with which the sleeve-shaped cup section (FIG. 1) is slipped over. The counter-holder 81 supports the front edge of the sleeve-shaped cup section 11 against further slipping over. It has, therefore, a support ring 52, which matches the contour and the size of the front edge of the sleeve-shaped cup section 11. The mandrel 8 serves to take up the sleeve-shaped cup section 11 for further processing.

The supporting ring 52 is attached to a ring nut 54 by a screw 53 or the like. The ring nut 54 is screwed onto a threaded bush 55, which in turn sits on a flange 56. The inner circumferential surface 90 of the threaded bush 55 lies, matching exactly, on an outer circumferential surface 82 of the flange 56. A front edge or counter-surface 83 of the threaded bush 55 lies, fitting exactly, on a front edge or fitting surface 84 of the flange 56. The circumferential surfaces 82, 90 and the front surfaces 83, 84 of the threaded bush 55 and the flange 56 form together a fitting device 89 with fitting surfaces and countersurfaces for the exact placing of the counter-holder 81 on the sleeve slip-over device 9.

The flange 56 is attached fixedly to the first turntable 7. The supporting ring 52 attached to the ring nut 54 is adjustable in relation to its axial position. The ring nut 54 consists of two sub-rings 57, 58 which can be braced against each other by a screw or the like, so that a set position in the case of the threaded bush 55 can be fixed. The threaded bush 55 is separably attached onto the flange 56 by a screw nut 60 or the like.

In the case of a change of format, the counter-holder 81 can also be exchanged. For this, the screw nut 60 is unscrewed after the mandrel 8 has been detached, and the threaded bush 55, including the supporting ring 52, is exchanged for another configuration threaded bush comprising a supporting ring. The axial position of the new counter-holder to be mounted is fixed outside of the paper cup making machine 1.

The mandrel 8 is fixed in a detachable way to the sleeve slip-over device 9, as is the counter-holder 81. So that components can be placed exactly matching, the sleeve slip-over device 9 is provided with a fitting device 86 (FIG. 6), against which a holding part of the mandrel 8 can be placed. The mandrel 8 has, apart from the above mentioned holding part 87, a fixedly associated outer surface 88 to match the form and contour of the sleeve-shaped cup section 11.

The holding part 87 is attached to a rod 91 by a screw 85 or the like. The rod 91 is movable axially inside the flange 56 along a guide against the force of a spring 92, whereby the rod 91 is secured against falling out by a screw nut which is screwed onto the rod 91 in the area of the first turntable 7. The rod 91 is provided with a collar 93 having a front surface or fitting surface 94. The holding part 87 is provided with a hollow cylindrical recess 95 which graduates over into a front surface or counter-surface 96 at its outgoing end.

In an assembled state, the inner circumferential surface or counter-surface 97 of the recess 95 lies against an outer circumferential surface or fitting surface 98 of the rod 91 and thus prevents radial sliding. The front surface 96 of the mandrel 8 bordering the recess 95 rests against the front surface 94 of the collar 93 of the rod 91 and thereby serves to ensure against axial sliding. Thus, the mandrel 8 can only be displaced together with the rod 91 in the axial direction against the force of the spring 92 by absorption of the pressure created by the sleeve-shaped cup section 11 on the mandrel 8.

In the case of a change of format, the mandrel 8 is exchanged for another one. The screw 85 is loosened, and the mandrel 8 is removed. The front surfaces 94, 96 as well as the circumferential surfaces 97, 98 guarantee that another mandrel will always be in the same position in relation to the other tools of the sleeve slip-over device 9.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A machine for producing sleeve-shaped containers from blanks of different size and shape, comprising processing stations operatively associated with each other for taking up, transporting and processing the blanks in different production stages, wherein at least one of the processing stations contains a device for slipping over a sleeve-shaped container section over a blank constituting a bottom of the container, the slip-over device comprising a counter-holder unit for putting on a front edge of the sleeve-shaped container section during slipping over and a mandrel for lateral support of the sleeve-shaped container section, wherein the counter-holder unit and the mandrel are configured to match both size and shape of the blanks and are selectively removably fixed to the slip-over device, and further at least one fitting device being fixable to the slip over device and having a fitting surface and a counter-surface at the removable counter-holder unit and configured to be placed in an exactly matching manner for precise placement of the counter-holder unit on the slip-over device.

2. The machine according to claim 1, wherein the slip over device comprises a section configured to match a form of the blank and is adjustable in relation to a section arranged to be placed on the fitting surface.

3. The machine according to claim 1, wherein the slip over device comprises a section configured to match a form of the material section, and is non-movably fixed to the section arranged to be placed on the fitting surface.

4. The machine according to claim 1, wherein the fitting surface and the countersurface are formed by opposing planar surfaces.

5. The machine according to claim 4, wherein the slip over device comprises a section configured to match a form of the blank and is adjustable in relation to a section arranged to be placed on the fitting surface.

6. The machine according to claim 5, wherein the slip over device comprises a section configured to match a form of the material section, and is non-movably fixed to the section arranged to be placed on the fitting surface.

7. The machine according to claim 1, wherein the fitting surface and the countersurface are formed by opposing outer circumferential surfaces of a cylinder and inner circumferential surfaces of a hollow cylinder.

8. The machine according to claim 1, wherein the counter-holder unit contains a supporting ring configured to match the front edge and adjustably connected to a threaded bush which is detachably connected to a flange arranged fixedly to a turntable on the machine, whereby an inner circumference of the threaded bush rests against an outer circumference of the flange, and a front surface of the threaded bush rests against a front surface of the flange.

9. The machine according to claim 1, wherein the counter-holder unit contains a supporting ring configured to match the front edge and adjustably connected to a threaded bush which is detachably connected to a flange arranged fixedly to a turntable on the machine, whereby an inner circumference of the threaded bush rests against an outer circumference of the flange, and a front surface of the threaded bush rests against a front surface of the flange.

10. The machine according to claim 1, wherein the mandrel comprises an outer surface configured to match a contour of the sleeve-shaped container section, which outer surface is non-movably connected to a holding part comprising a hollow cylindrical recess and a front surface, said holding part being detachably connected to a rod which is attached to the turntable, whereby an inner circumferential surface of the hollow cylindrical recess rests against an outer circumferential surface of the flange and a front surface of the holding part rests against a front surface of the rod.

* * * * *